US007237516B2

(12) United States Patent
Kunz

(10) Patent No.: US 7,237,516 B2
(45) Date of Patent: Jul. 3, 2007

(54) METHOD FOR CONTROLLING AN ACTUATOR, USING A RETAINING MARK SPACE RATIO

(75) Inventor: Franz Kunz, Altmannstein (DE)

(73) Assignee: Siemens Aktiengesellshaft, Munich (DE)

( * ) Notice: Subject to any disclaimer, the term of this patent is extended or adjusted under 35 U.S.C. 154(b) by 745 days.

(21) Appl. No.: 10/220,552

(22) PCT Filed: Mar. 2, 2001

(86) PCT No.: PCT/DE01/00796

§ 371 (c)(1),
(2), (4) Date: Jan. 13, 2003

(87) PCT Pub. No.: WO01/65076

PCT Pub. Date: Sep. 7, 2001

(65) Prior Publication Data

US 2006/0124089 A1 Jun. 15, 2006

(30) Foreign Application Priority Data

Mar. 2, 2000 (DE) ..... 100 10 233

(51) Int. Cl.
*F01L 1/34* (2006.01)

(52) U.S. Cl. ..... 123/90.17; 123/90.11; 123/90.15; 123/90.18; 123/90.12; 251/129.05; 251/129.06

(58) Field of Classification Search ..... 123/90.17, 123/90.11
See application file for complete search history.

(56) References Cited

U.S. PATENT DOCUMENTS 4,366,524 A * 12/1982 Kuroiwa et al. ..... 361/154
6,155,654 A * 12/2000 Oyama ..... 303/117.1

FOREIGN PATENT DOCUMENTS

| | | | |
|---|---|---|---|
| DE | 3729183 | A1 | 3/1989 |
| DE | 4232836 | C1 | 9/1993 |
| DE | 19818126 | A1 | 10/1999 |
| EP | 0518528 | A1 | 12/1992 |
| EP | 0735245 | A1 | 10/1996 |
| EP | 0942154 | A2 | 9/1999 |

* cited by examiner

*Primary Examiner*—Thomas Denion
*Assistant Examiner*—Kyle M. Riddle
(74) *Attorney, Agent, or Firm*—Hanley, Flight & Zimmerman, LLC

(57) ABSTRACT

The invention relates to a method for controlling an actuator which can be displaced between two end positions, said actuator being impinged in one end position and being capable of displacement to the other end position by an electromagnetic part. The actuator is first supplied with an electromagnetic current using a pulse-duration modulation in a retaining mark space ratio. Once the application of current has ended, an oversaturation of the electromagnet is taken into consideration, either by influencing the application of current in the mark space ratio in an appropriate manner, or the oversaturation is completely prevented by a suitable configuration of the application of current.

4 Claims, 4 Drawing Sheets

METHOD FOR CONTROLLING AN ACTUATOR, USING A RETAINING MARK SPACE RATIO

Figure 1:
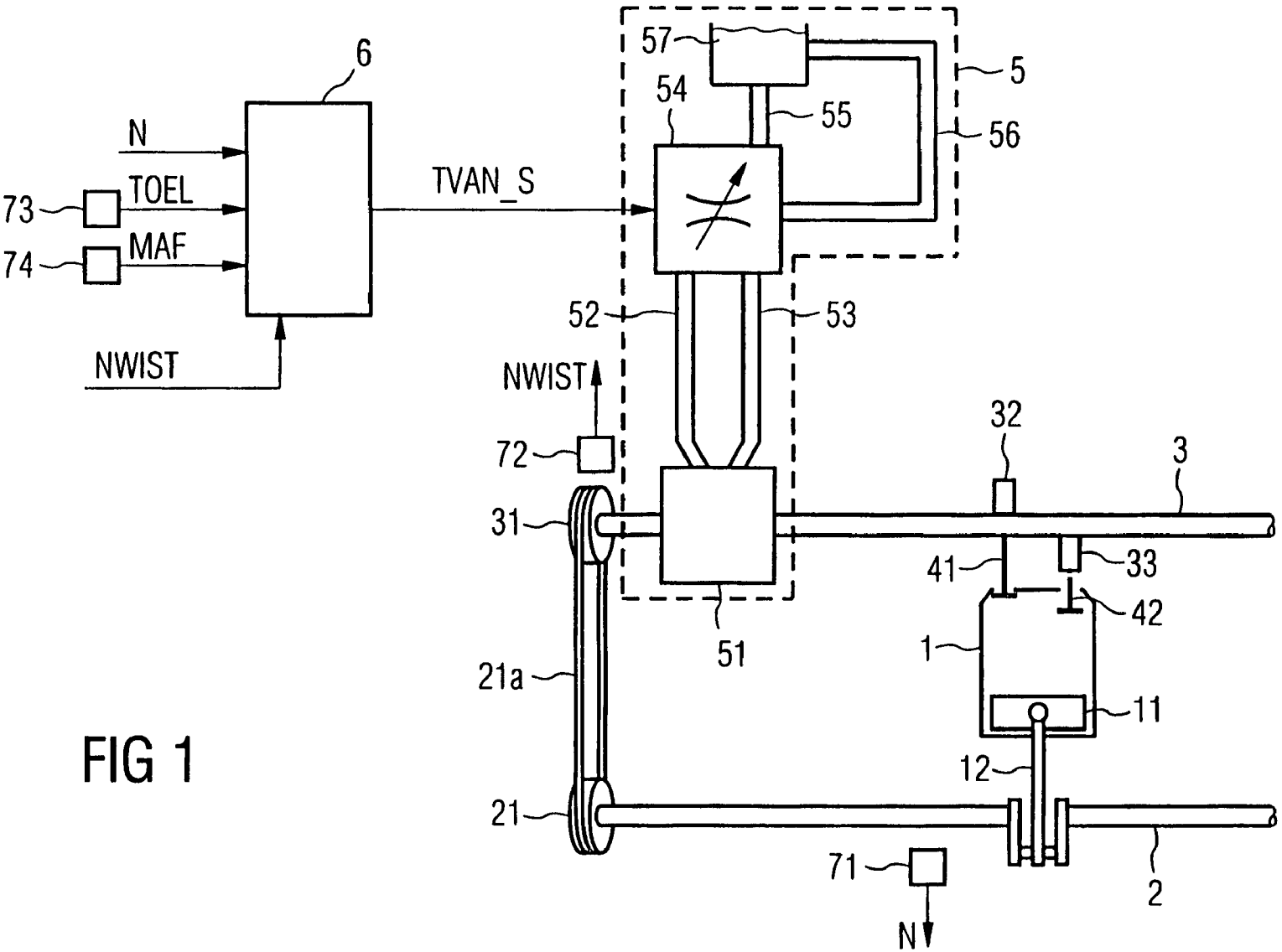

The invention relates to a method for controlling an actuator which is moveable between two end positions, is acted on in one end position and can be moved toward the other end position by an electromagnetic part.

Such actuators are employed for example in apparatuses for camshaft adjustment in internal combustion engines. Such a camshaft adjusting apparatus is described, in DE 43 40 614 C2, for example.

This adjusting device is a typical example of an actuator which is influenced by an electromagnetic part, in the case of which it is ascertained that the maximum regulating speed that can be achieved is noticeably reduced by dead times and delayed response. It has been shown in practice that a corresponding regulator can be parameterized in such a way that either a jump to a new desired position is tracked only slowly, or that a jump to a new desired position is admittedly tracked rapidly but the system thereby becomes unstable. However, both rapid tracking in the event of jumps in the desired position and a large stability margin are required especially in the case of camshaft adjusting apparatuses.

Therefore, the invention is based on the object of specifying a method for controlling an actuator of the type described with which a faster response is achieved without reducing the stability margin.

The invention is achieved by means of one of the methods described in claims 1, 5 and 6.

The invention is based on the insight essential to the invention that the oversaturation of the electromagnet in the electromagnetic part acting on the actuator is an essential factor that reduces the response speed. Therefore, either the oversaturation is completely avoided through suitable driving of the electromagnet, or the oversaturation of the electromagnet is correspondingly taken into account during the transition between energization of the electromagnetic part and holding of the actuator in a desired position.

In one embodiment of the method, it is provided that, upon recommencement of the pulse-width-modulated energization in the holding duty ratio, either a certain number of pulses of the holding duty ratio are omitted or the pulse-width-modulated energization in the holding duty ratio is begun in a manner delayed by a certain time duration.

The omission of pulses or the delay enables the electromagnet of the electromagnetic part, which electromagnet is in oversaturation, to leave the latter. This prevents the immediate changeover to the pulse-width-modulated energization in the holding duty ratio from still holding the electromagnet unnecessarily longer in oversaturation, which would result in a delayed changeover from the adjustment of the actuator, which was effected by the energization of the electromagnet, to the holding of the actuator, which is effected by the energization in the holding duty ratio.

If it is desired to avoid oversaturation of the electromagnet of the electromagnetic part from the outset, the energization of the electromagnetic part can be performed with a frequency above the fundamental frequency of the pulse width modulation. If the electromagnet is energized at high frequency with a duty ratio which lies above the holding duty ratio but still significantly below 100%, what is achieved is largely maximum actuating speed of the actuator without driving the electromagnet of the electromagnetic part into oversaturation or saturation. The value that can be chosen here for the duty ratio during the energization with relatively high frequency may be 70%, for example, since the difference in the effect of the electromagnetic part between 70% and continuous energization can be disregarded, particularly if an electromagnetic valve is involved.

An unnecessary inertia of the electromagnetic part or undesired lengthening of its energization is also avoided by the commencement of the energization and/or the recommencement of the pulse width modulation in the holding duty ratio being effected level-synchronously. In this case, the energization begins at the next possible instant at which the holding duty ratio exhibits a level opposite to the energization. The pulse-width-modulated energization in the holding duty ratio then begins with the opposite level of the energization, independently of the level to be expected according to the fundamental frequency. What is thereby achieved is that the energization time duration corresponds exactly to the predetermined time period and is not lengthened by preceding or succeeding high-level sections of the pulse-width-modulated energization in the holding duty ratio. In an alternative modification of this design, it is possible, upon request of an energization at an instant at which pulse-width-modulated energization in the holding duty ratio is presently at a high level, to begin immediately with the energization, to shorten the latter by a pulse width of the holding duty ratio and then to commence the energization in the holding duty ratio once again level-synchronously, as mentioned.

The subclaims relate to advantageous refinements of the invention.

Figure 2:
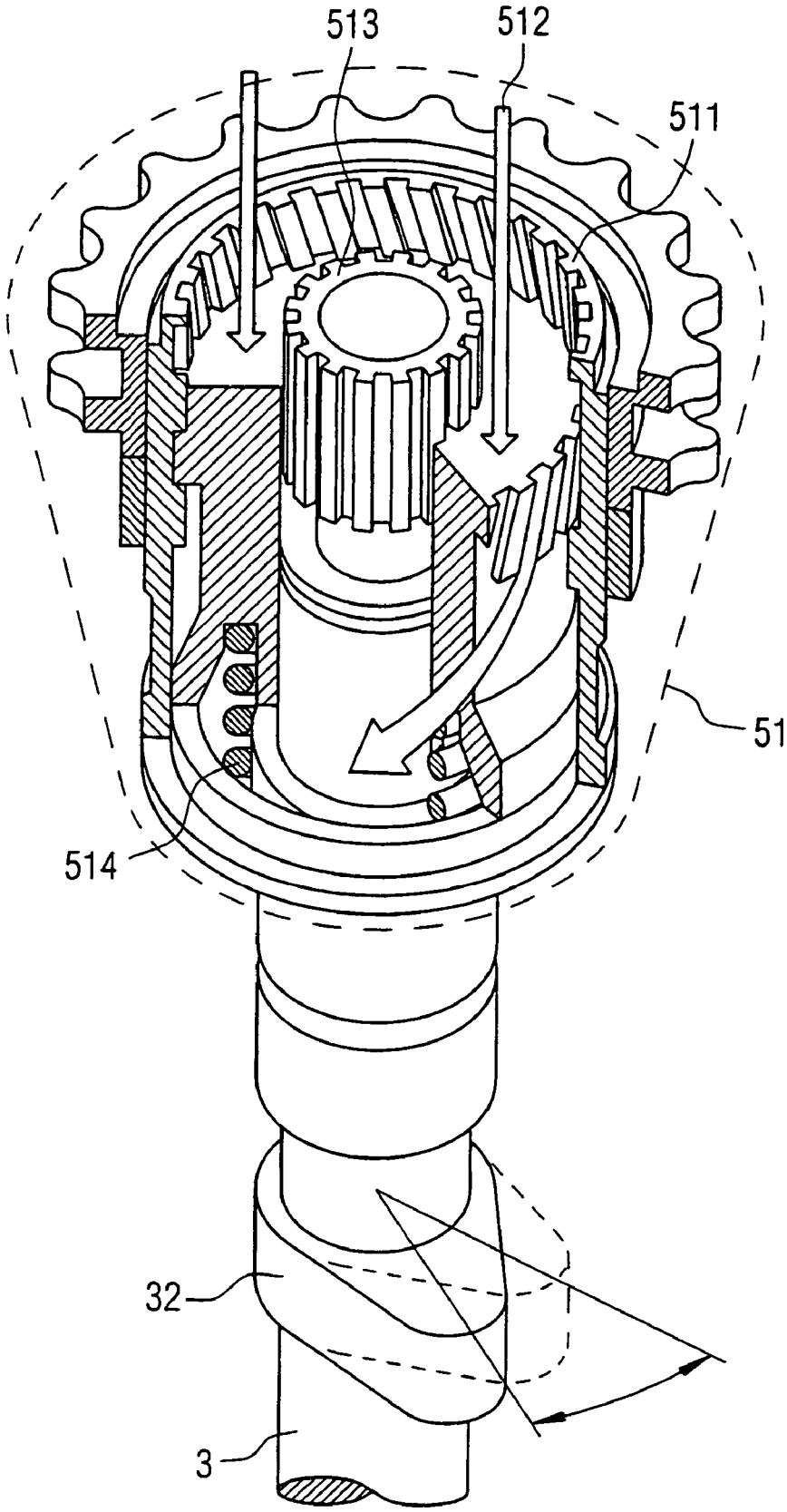
Figure 3:
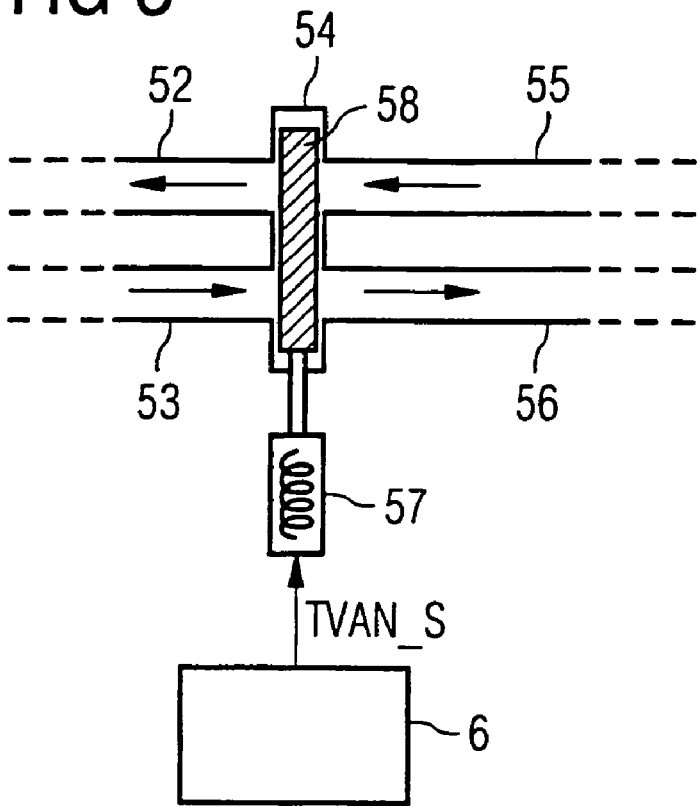

The invention is explained in more detail below using exemplary embodiments with reference to the drawing, in which:

FIG. 1 shows a diagrammatic illustration of an internal combustion engine with camshaft adjustment, FIG. 2 shows a camshaft with cut-away mechanical adjusting part, FIG. 3 shows a block diagram of the electromagnetic part which influences the camshaft adjustment, and FIGS. 4 to 7 show time series of the driving of the electromagnetic part.

In the figures, elements having an identical construction and function are provided with the same reference symbols.

An internal combustion engine illustrated diagrammatically in FIG. 1 comprises a cylinder 1 with a piston 11 and a connecting rod 12. The diagrammatic drawing of FIG. 1 only illustrates one cylinder; of course, an internal combustion engine is generally a multicylinder internal combustion engine. The connecting rod 12 is connected to a piston 11 and a crankshaft 2. A first gearwheel 21 is seated on the crankshaft 2 and is coupled via a chain 21*a* to a second gearwheel 31, which drives a camshaft 3. The camshaft 3 has cams 32, 33 which actuate the gas exchange valves 41, 42.

In order to adjust the position of the camshaft 3 relative to the crankshaft 2, provision is made of an actuator 5. It has a mechanical adjusting part 51, which is ordered by an electromagnetically actuated 2-/3-way valve 54 via hydraulic lines 52, 53. The valve 54 is connected to an oil reservoir via a high-pressure hydraulic line 54 and a low-pressure hydraulic line 56 and an oil pump (not illustrated) provides for the generation of the pressure in the high-pressure hydraulic line 55.

A control unit 6 drives the valve 54 by means of a drive signal TVAN_S. In this case, the control unit 6 prescribes the drive signal TVAN_S depending on the values of diverse sensors 71 to 74. These are sensors for measuring the rotational speed N, the crankshaft angle of the crankshaft 2, the camshaft position NWIST, the air mass MAF sucked in by the internal combustion engine, and the temperature TOEL of the oil which drives the adjusting part 51. Of course, this sensor complement is to be understood only by way of example.

FIG. 2 shows the camshaft 3 with the mechanical adjusting part 51 as a partial sectional diagram. The mechanical adjusting part 51 is driven by the second gearwheel 31, in which a third gearwheel 511 is seated in a positively locking manner. This third gearwheel 511 has an internal helical gearing which engages into an assigned external helical gearing of a gear rim 512 seated in the third gearwheel 511. Said gear rim has a hole with a spur gearing which engages into a corresponding gearing of a fourth gearwheel 513. What is thus achieved is that, independently of the axial position of the gearwheel 512, the fourth gearwheel 513 fitted to the camshaft 3 does not change its axial position even though the gear rim 512 is connected to the fourth gearwheel 513 in a manner fixed against rotation.

Depending on the oil pressure in the hydraulic lines 52, 54, the gear rim 512 is now displaced axially with respect to the camshaft. As a result of the intermeshing external helical gearing of the gear rim 512 and the internal helical gearing of the third gearwheel 511, this results in a rotation of the camshaft 3 relative to the third gearwheel 511, which is connected to the second gearwheel 31 in a manner fixed against rotation.

A spring 514 constrains the gear rim 512 away from the camshaft 3 and thus the adjustment of the camshaft 3 toward one end position. By means of the oil pressure in the hydraulic lines 52, 53, it is possible to achieve an adjustment of the rotational position of the cam 32 relative to the second gearwheel 31 driving the camshaft 3, said adjustment being indicated diagrammatically in FIG. 2 by dashed illustration.

The actuator 5 thus effects a phase adjustment of the camshaft 3 relative to the crankshaft 2. The phase can be continuously adjusted within a predetermined range. Since both the camshaft 3 which serves for actuating the inlet gas exchange valves and a camshaft for actuating the outlet gas exchange valves can be correspondingly provided with an actuator 5, it is possible to vary the stroke beginning and the stroke end—prescribed by way of the cam form—of the gas exchange valves.

FIG. 3 illustrates the valve 54 with its electromagnetic driving in more detail as a diagrammatic illustration. The valve 54 has a slide 58. The slide 58 is set by an electromagnet 57. It has a system of holes (not illustrated in the diagrammatic drawing) via which the pressure on the high-pressure hydraulic line 55 can be forwarded in an adjustable manner to the hydraulic line 52, which delivers its oil to the gear rim 512 in the direction of the arrows shown in FIG. 2. Oil flowing through the gear rim, said oil being illustrated by the downwardly pointing bent arrow in FIG. 2, is fed back via the line 53 under low pressure and conducted through corresponding holes in the slide 58 to the low-pressure hydraulic line 56.

The method of operation of this valve 54 is of interest for understanding the invention only insofar as the energization of the electromagnet 57 sets the pressure on the gear rim 512 counter to the spring 514. If the electromagnet 57 is not energized, no pressure acts on the gear rim 512 through hydraulic oil from the line 52, for which reason the spring 514 is not opposed by a force and the gear rim 512 is forced away into its axial end position by the camshaft 3. This corresponds to one end position of the camshaft adjustment range.

If the electromagnet 57 is maximally energized, the other end position of the camshaft adjustment range is reached.

For the energization, the electromagnet 57 is driven with the drive signal TVAN_S. In this case, a voltage signal is discussed below, but a current signal is also possible as direct energization.

In order to hold the actuator 5 in a specific position, the drive signal TVAN_S is pulse-width-modulated with a holding duty ratio. In this case, the holding duty ratio is chosen such that the slide 58 remains exactly in a predetermined position in which the force acting on the gear rim 512 in the hydraulic line 52 exactly compensates for the force of the spring 514 in a desired position of the gear rim 512. The spring 514 is designed in such a way that the force which it exerts is identical for every camshaft position. The holding duty ratio is then identical for all positions of the gear rim 512 and, consequently, for all camshaft settings. The holding duty ratio generally lies in the vicinity of 50%. Of course, in the case of non-constant springs, the holding duty ratio may also depend on the camshaft position, but this is not discussed below.

In order to bring the camshaft position from one specific position to another, the electromagnet 57 is energized to a greater extent in the case of an adjustment which means a pressure increase. However, this depends on the design of the slide 58. Greater energization may also result in a reduction of the pressure in the hydraulic line 52. It is assumed below that a greater energization of the electromagnet 57 brings about an increase in the pressure in the line 52.

Figure 4:
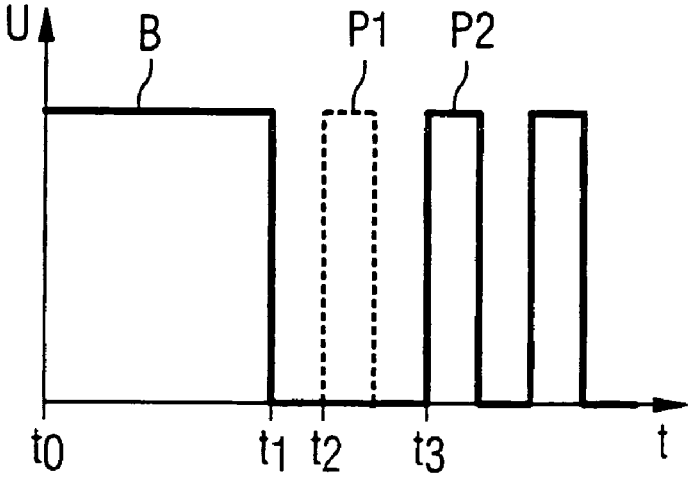

If the control unit 6 ascertains that an adjustment of the camshaft 3 which requires a pressure increase in the hydraulic line 52 is necessary, it effects an energization B of the electromagnet 57 in a first embodiment. This is illustrated in FIG. 4 by the solid line between the instants $t_0$ and $t_1$. In this case, $t_0$ is the instant at which the control unit 6 begins the energization. This is generally the instant at which the camshaft adjustment was requested. The control unit 6 configures the time period between the instant $t_0$ of the beginning of the energization B and the instant $t_1$ of the end of the energization B with a varying length depending on the requested adjustment. If the energization has ended at $t_1$, a changeover is made to energization in the holding duty ratio again.

Since the electromagnet 57 is in a certain saturation or oversaturation as a result of the energization B, however, the next pulse P1 of the energization in the holding duty ratio, which would be due at the instant $t_2$, is omitted. The energization in the holding duty ratio is begun only with the next but one pulse P2 at the instant $t_3$. Of course, it is possible to omit not just one pulse P1 but also a plurality of pulses. The omission of one or more pulses P1 takes account of the oversaturation of the electromagnet 57, which leads to the slide 58 not immediately being moved back into the holding position again at the instant $t_1$, in which position the pressure in the line 52 corresponds to the pressure which is necessary for holding the gear rim 512 in the newly set position. However, in order to axially fix the gear rim 512 as rapidly as possible, i.e. to set the pressure in the line 52 to the desired amount, one or more pulses P1 are omitted. The number of pulses P1 to be omitted is to be chosen in a manner dependent on the conditions of the electromagnet 57.

Figure 5:
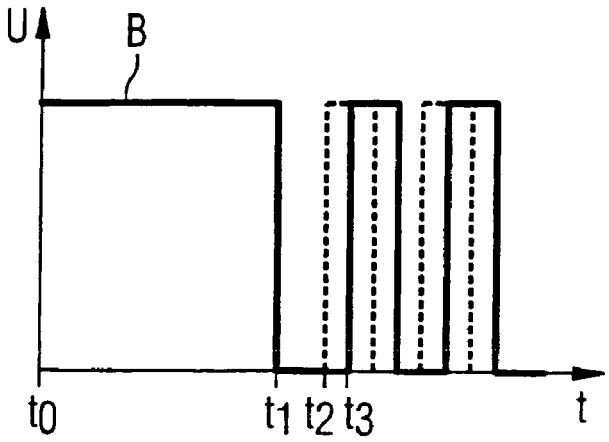

Instead of omitting a number of pulses P1, in the variant illustrated in FIG. 5, it is also possible to delay the commencement of the energization in the holding duty ratio by a variable time period. The energization in the holding duty ratio is not begun at the instant $t_2$, rather the energization does not commence until the instant $t_3$. This variant affords greater flexibility in the coordination with the conditions of the electromagnet 57.

Figure 6:
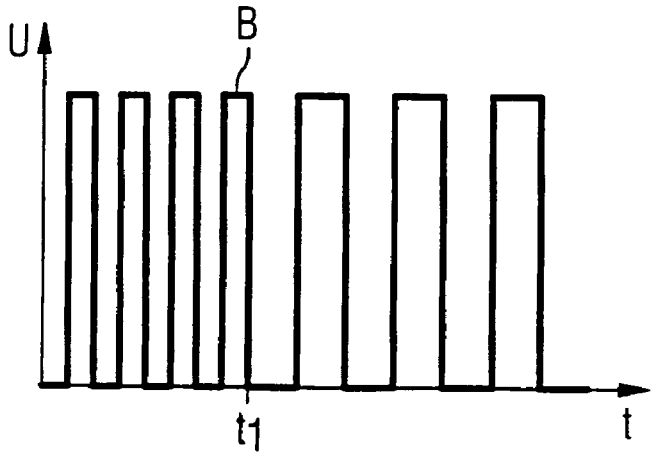
Figure 7:
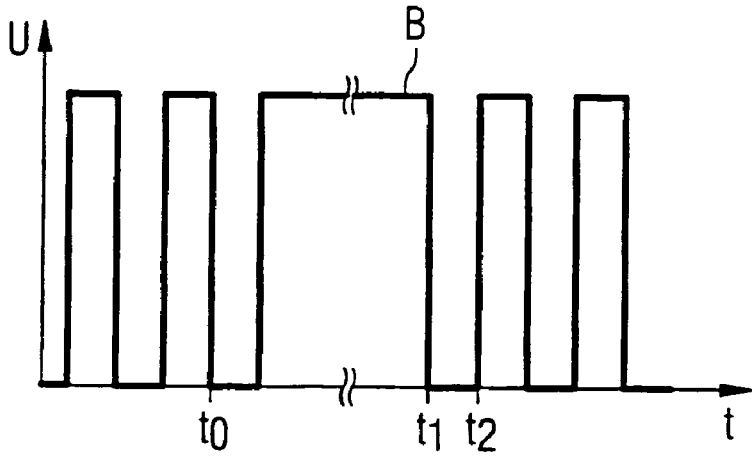

As an alternative, it is possible, during the energization of the electromagnet 57, to prevent the latter from attaining saturation or oversaturation. The requisite driving by the drive signal TVAN_S is illustrated in FIG. 6.

In this variant, the electromagnet 57 is energized with a frequency above the frequency of the pulse width modulation of the holding duty ratio. It is thus possible to set a degree of energization of 70%, for example. In the case of such a degree of energization, which should generally lie above the degree of energization of the holding duty ratio but still below an energization of 100%, as is used in the variants of FIGS. 4 and 5, a sufficient pressure increase is achieved in the hydraulic line 52 and, consequently, a sufficiently rapid movement of the gearwheel 512 is achieved, without driving the electromagnet 57 into saturation or oversaturation. After the required energization time duration has elapsed, at the instant $t_1$, a changeover is immediately made to the energization in the holding duty ratio. In FIG. 6, for simplification, the duty ratio during the energization with higher frequency is depicted equal to 50%; in reality, of course, the duty ratio is higher.

In a further variant, the time behavior of the valve 54 actuated by the electromagnet 57 is configured as desired by a corresponding choice of level at the beginning and end of the energization. If the control unit 6 ascertains, at the instant $t_0$, that a camshaft adjusting operation is necessary, an energization B is not immediately begun if the energization in the holding duty ratio currently exhibits a high level. Only when the next low level has elapsed is the energization B begun. After the end of the energization B at the instant $t_1$, the energization in the holding duty ratio is continued with the level opposite to the energization. This is the low level in this case. Only after the required low-level time of the energization in the holding duty ratio has elapsed is the next high level effected. What is achieved by this level-synchronous initiation of the energization and of the recommencement of the holding duty ratio is that the energization B for camshaft adjustment has exactly the predetermined time duration and is not lengthened by preceding or succeeding high-level pulses of the energization in the holding duty ratio. If an even faster reaction to requests of camshaft adjustments is desired in this variant, the energization B can be begun immediately at the instant $t_0$. In order to prevent the energization B from then being lengthened due to a directly preceding high level of the energization in the holding duty ratio, the time duration of the energization B, which time duration is normally to be provided by the control unit 6, must be shortened by the time duration which a high level of the energization in the holding duty ratio presented directly before the beginning of the energization B. The recommencement of the energization in the holding duty ratio after the instant $t_1$ at the end of the energization B is then again effected in the level-synchronous manner described.

What is claimed is:

1. A method for controlling an actuator which is moveable between two end positions, is acted on in one end position and can be moved toward the other end position by an electromagnetic part, in which method a) the actuator is held in a desired position between the end positions by energizing the electromagnetic part with a pulse width modulation in a holding duty ratio, b) in order to alter the position of the actuator toward the other end position, the electromagnetic part is permanently energized for a specific time duration dependent on the change in position, and c) after the end of the specific time duration, the energization with a holding duty ratio commences in a delayed manner and, in between, the electromagnetic part is not energized, wherein a specific number of pulses of the holding duty ratio are omitted to delay the holding duty ratio.

2. The method as claimed in claim 1, characterized in that the delay is chosen depending on a time constant which depends on the electrical resistance, the electrical capacitance and/or the inductance of the electromagnetic part.

3. The method as claimed in claim 2, characterized in that, after the delay, the current in the electromagnetic part has fallen to approximately 37%.

4. A method for controlling an actuator which is moveable between two end positions, is acted on in one end position and can be moved toward the other end position by an electromagnetic part, in which method a) the actuator is held in a desired position between the end positions by energizing the electromagnetic part with a pulse width modulation in a holding duty ratio, b) in order to alter the position of the actuator toward the other end position, the electromagnetic part is permanently energized for a specific time duration dependent on the change in position, in which case c) the energizing in step b) is begun at the level of the pulse width modulation of the holding duty ratio that is opposite to the energization and/or is continued after the energization with the level of the pulse width modulation of the holding duty ratio that is opposite to the energization, wherein with a request for a change in position of the actuator, an energization according to step b) immediately takes place and the specific time duration is shortened by the time duration between the beginning of the last high level, preceding the beginning of energization, of the pulse-width-modulated energization in the holding duty ratio and the beginning of the energization if the energization was begun at a high level of the holding duty ratio.

* * * * *